US009234162B2

(12) United States Patent
Pathak et al.

(10) Patent No.: US 9,234,162 B2
(45) Date of Patent: Jan. 12, 2016

(54) CLEANING COMPOSITION AND METHODS OF USE THEREOF

(71) Applicant: LMC ENTERPRISES, Paramount, CA (US)

(72) Inventors: Kishor Pathak, Huntington Beach, CA (US); Marija Rajovic-Simovic, Torrance, CA (US)

(73) Assignee: LMC ENTERPRISES, Paramount, CA (US)

( * ) Notice: Subject to any disclaimer, the term of this patent is extended or adjusted under 35 U.S.C. 154(b) by 402 days.

(21) Appl. No.: 13/750,795

(22) Filed: Jan. 25, 2013

(65) Prior Publication Data

US 2014/0209127 A1 Jul. 31, 2014

(51) Int. Cl.

| | |
|---|---|
| ***C11D 3/33*** | (2006.01) |
| ***C11D 1/06*** | (2006.01) |
| ***C11D 1/83*** | (2006.01) |
| *C11D 3/00* | (2006.01) |
| *C11D 3/04* | (2006.01) |
| *C11D 1/722* | (2006.01) |

(52) U.S. Cl.

CPC .. *C11D 3/33* (2013.01); *C11D 1/06* (2013.01); *C11D 1/83* (2013.01); *C11D 1/722* (2013.01); *C11D 3/0026* (2013.01); *C11D 3/044* (2013.01)

(58) Field of Classification Search

CPC ..... C11D 3/0026; C11D 1/72; C11D 3/3707; C11D 11/0023; C11D 1/722; C11D 3/044

See application file for complete search history.

(56) References Cited

U.S. PATENT DOCUMENTS

| | | | | |
|---|---|---|---|---|
| 5,523,194 | A * | 6/1996 | Archer | 430/331 |
| 6,537,960 | B1 * | 3/2003 | Ruhr et al. | 510/423 |
| 6,686,324 | B2 * | 2/2004 | Ramirez et al. | 510/218 |
| 7,507,697 | B1 * | 3/2009 | Shertok et al. | 510/218 |
| 8,343,905 | B2 * | 1/2013 | Gutierrez et al. | 510/237 |
| 2007/0017553 | A1 * | 1/2007 | Neplenbroek et al. | 134/25.2 |
| 2009/0054287 | A1 * | 2/2009 | Smith et al. | 510/161 |
| 2009/0093389 | A1 * | 4/2009 | Tijanic et al. | 510/161 |
| 2009/0325841 | A1 * | 12/2009 | Erickson et al. | 510/234 |
| 2010/0068295 | A1 * | 3/2010 | Bobbert | 424/616 |
| 2010/0236582 | A1 * | 9/2010 | Heintz et al. | 134/26 |

* cited by examiner

*Primary Examiner* — Gregory Webb

(74) *Attorney, Agent, or Firm* — Loeb & Loeb LLP

(57) ABSTRACT

Embodiments of the disclosure are directed to a stable cleaning composition comprising: a chelating agent, a low-foaming, temperature- and alkaline-stable surfactant, and water. Other embodiments relate to the methods of preparing the stable cleaning compositions and the methods of their use. The stable cleaning composition described here is a low cost cleaning composition for use either alone or as an additive to a cleaning agent.

26 Claims, No Drawings

CLEANING COMPOSITION AND METHODS OF USE THEREOF

FIELD OF THE INVENTION

The present disclosure is generally directed to cleaning compositions, which are used in cleaning or removing foreign matter from surfaces, for example, hard or solid surfaces.

BACKGROUND

Clean In Place (CIP) systems are generally methods of cleaning the interior surfaces of pipes, vessels, evaporators, process equipment, filters and associated fittings, and the like, without disassembly. These cleaning systems commonly utilize strongly acidic or basic formulated cleaners. By pumping cleaners through the pipes and vessels, all of the interior surfaces that are contacted with cleaning materials are effectively cleaned, removing contaminants, or contaminating films.

These CIP procedures are typically used to clean the surfaces of dairy, food, or beverage processing equipment. Cleaning processes are only as effective as the cleaner that is pumped through the processing equipment interiors. Historically, CIP processes use chelated sodium or potassium hydroxide solution, such as sodium hydroxide with sodium gluconate, as a low cost cleaner. However, for dairy, food, or beverage processing plants that require pasteurization at high temperatures, additives such as water conditioners and surfactants are added to the cleaning compositions. In order to produce an effective cleaning composition, the highest concentrations of chelated sodium or potassium hydroxide solution and additives are desired. Yet, the solubility of the additives is limited by the high concentration of the chelated sodium or potassium hydroxide solution. The higher the concentration of the chelated sodium or potassium hydroxide solution, the more difficult it is for additives to solubilize. To overcome this problem, many users have reduced the chelated sodium or potassium hydroxide solution concentration, thereby requiring more water in the cleaning composition, which results in higher costs and increased water usage.

More environmentally compatible cleaning compositions are desirable. A concerted effort remains to reduce the amount of cleaning chemicals used in the process, and reduce, if not completely eliminate, wastewater produced in processes such as, for example, CIP systems. The selection of effective cleaning compositions that are not only low in cost, but also reduce the amount of cleaning chemicals: acids and bases, water, and waste produced, are therefore essential and highly desirable. A substantial need exists to produce an effective, low cost, and low environmental impact cleaning composition.

BRIEF SUMMARY

It is therefore an object of the invention to provide an effective, low cost, and stable food-contact-surface (FCS) composition devoid of the above deficiencies.

One embodiment is directed to a stable FCS composition comprising: a low-foaming, temperature- and alkaline-stable surfactant, a chelating agent, and water. The low-foaming, temperature- and alkaline-stable surfactant may comprise of one or more surfactants or surfactant blends.

Another embodiment provides a method of cleaning a FCS, comprising: (a) applying a surface cleaning agent to the FCS; (b) applying a stable cleaning composition comprising a chelating agent and a low foaming, temperature- and alkaline-stable surfactant, and water, to the FCS; (c) optionally, applying an acid wash to the FCS after the cleaning agent and the cleaning composition application and before rinsing with water; and (d) rinsing the cleaning composition and/or acid-washed FCS with water. Sanitizing and additional rinsing steps may be applied to the FCS in compliance with industry standards.

Non-limiting exemplary cleaning agents may include, caustic soda or sodium hydroxide, caustic potash or potassium hydroxide, sodium gluconate, phosphonate, gluconic acid, any of which may additionally contain alkaline builders, surfactants, chelating agents, and/or solvents. The acid wash may include, but are not limited to, diluted organic or inorganic acids, such as, for example, phosphoric and nitric acids, hydrochloric acid, sulphuric acid, citric acid, and the like.

Yet a further embodiment is directed to a method of preparing a stable FCS cleaning composition comprising: mixing (a) a low foaming, temperature- and alkaline-stable surfactant; (b) a chelating agent; and (c) water.

These and other embodiments will be apparent to those of skill in the art and others in view of the following detailed description. It should be understood, however, that this summary and the detailed description illustrate only some examples, and are not intended to be limiting to the invention as claimed.

DETAILED DESCRIPTION

Embodiments of the invention relate to cleaning compositions, i.e., stable surface cleaning compositions. The cleaning composition may clean surfaces found in industrial plants that process products for consumption or application. These surfaces may include but are not limited to hard, solid, and/or flexible surfaces. Exemplary industries in which embodiments of the invention comprising compositions and methods can be applied include, but are not limited to: the food and beverage industry, e.g., the dairy, cheese, sugar, soda, and brewery industries; the pharmaceutical, vitamin/supplement, and nutraceutical manufacturing industries; cosmeceutical and cosmetic industries; and any other industry that manufactures or processes products for consumption or consumer application. It is contemplated that the compositions and methods of the invention may be applied to any industry that requires the cleaning of equipment, floors, surfaces, and the like. The surfaces to be cleaned include those that come into contact with products for consumption and consumer application. These surfaces from a variety of product industries are described here as food-contact-surfaces (FCS), even if food does not come into contact with the surfaces that will be cleaned.

Compositions

In one embodiment, a stable composition that cleans food-contact-surfaces (FCS) as described here, includes: a low-foaming, temperature- and alkaline-stable surfactant, a chelating agent, and water. One example of a stable composition may comprise: an anionic/non-ionic alkyl ether carboxylic acid (or salt thereof) surfactant, a chelating agent, and water. Another example of a stable composition may comprise: an alkyl ethoxylated carboxylic acid (or salt thereof) surfactant, a chelating agent, and water. The composition, cleaning composition, stable surface cleaning composition, or FCS cleaning composition, all of which may be used interchangeably here, may be used alone or as an additive for enhancing the performance of other cleaning products and agents.

These other cleaning products, cleaning agents, surface cleaning agents, or surface cleaners, all of which are used interchangeably here, include, but are not limited to, alkaline builders, surfactants, chelating agents, and/or solvents, such as for example, chelated caustic soda, chelated caustic potash, sodium gluconate, gluconic acid, nitric and phosphoric acids, tetrapotassium pyrophosphate (TKPP), ethylenediaminetetraacetic acid (EDTA), $Na_4EDTA$, and the like. These cleaning agents may be dispensed by pressure washers, steam cleaners, and the like, or contained in CIP cleaners, degreasers, and the like. A preferred cleaning agent comprises sodium gluconate, sodium hydroxide, and water.

Low foaming surfactants have a foam height ranging from about 0 mL to about 250 mL as measured by a Cylinder Shake Foam Height test (see, Example 3, Table 5). Briefly, the initial height of the foam after vigorously shaking in a graduated cylinder is measured and then after five minutes the foam height is measured again. The height of the liquid just below the foam after 1 minute and after 5 minutes may also be measured. Generally, low foam height values have an initial reading of less than or equal to about 250 mL and a reading after 5 minutes of less than or equal to about 50 mL. Whereas, high foam values have an initial reading of greater than 250 mL and a reading after 5 minutes of greater than or equal to about 250 mL. Other tests may also be used in determining low foaming surfactants, such as, for example, measured by a Blender Foam test and Ross-Miles Foam Height test. Some commercially available surfactants that are dependent on heat to produce the low-foaming property are not considered low-foaming surfactants as used here. Preferred low-foaming surfactants or surfactant blends described and utilized here are temperature-stable or non-heat activated.

A surfactant of the stable cleaning composition as described here may be one surfactant or more than one surfactant in a blend or combination. A surfactant blend is a blend or combination of individual surfactants. Non-limiting examples of surfactant blends may include anionic/non-ionic alkyl ether carboxylic acids or their salts. One class of preferred surfactants useful in the stable composition includes those that are low-foaming, temperature-stable, alkaline-stable, hypochlorite-stable, and/or particularly stable under strong pH conditions. These surfactants may also have high dispersing and hydrotrope abilities and allow the formulation of cleaners with a high electrolyte and builder content. Builders are typically added to a cleaning compound to enhance the cleaning efficiency of the surfactant. Builders have a number of functions including softening, buffering, and emulsifying. One class of preferred surfactants useful in the stable composition includes alkyl ethoxylated carboxylic acids or their salts.

In one embodiment, a preferred low-foaming, temperature- and alkaline-stable surfactant is a blend of surfactants, such as but not limited to, a mixed alcohol ether carboxylate surfactant blend. For example, a preferred low-foaming temperature- and alkaline-stable surfactant is capryleth-9 carboxylic acid (and) hexeth-4 carboxylic acid (CAS #53563-70-5 and CAS #105391-15-9), also known as a blend of glycolic acid ethoxylate octyl ether (and) Poly(oxy-1,2-ethanediyl), alpha-(carboxymethyl)-omega-(hexyloxy).

Another class of low-foaming, temperature- and alkaline-stable surfactants includes surfactants that are particularly useful in combination with low-foaming, temperature-stable, alkaline-stable hydrotrope surfactants. The C12-C14 linear alcohol ethylene oxide/propylene oxide (EO/PO) low-foaming, non-ionic surfactant class may preferably be combined with the low-foaming, temperature-stable, alkaline-stable hydrotrope surfactants described here. A preferred C12-C14 linear alcohol EO/PO low-foaming, non-ionic surfactant is CAS #68439-51-0 (Surfonic® LF-17; Huntsman Petrochemical Corporation; Houston, Tex.). Without being bound by theory, at a certain dilution of about 1% to about 5%, the C12-C14 linear alcohol EO/PO low-foaming, non-ionic surfactant has specific properties that yields low foam height. The hydrotrope surfactant assists in solubilizing the non-ionic surfactant in order to obtain the maximum benefit of both surfactants.

However, not all low-foaming surfactants are suitable for the stable cleaning composition described here. Compositions containing these unsuitable low-foaming surfactants are not stable under normal room temperature (~20° C.) and pressure (1 atm). Instability or lack of stability may refer to the separation of elements or clouding of the composition. In fact, several surfactants that are not useful in formulating a suitable stable cleaning composition as described here include: methyl-oxirane polymer with oxirane of various molecular weights (CAS #9003-11-6); alcohols, C12-C15, ethoxylated propoxylated (CAS #68551-13-3); benzyl-polyethylene glycol tert-octyphenyl ether (CAS #60864-33-7); amines, C12-C14-ter-alkyl, ethoxylated propoxylate (CAS #68603-58-7); 4-nonylphenoxy polyehoxy polypropoxy ethyl acetal (CAS #160799-28-0); butanedioic acid (CA #28805-58-5); alcohol alkoxylate; alkylether hydroxpropyl sultaine; and alcohols, C12-C15, branched and linear, ethoxylated propoxylated (CAS #120313-48-6).

Another element of the stable cleaning composition described here is the chelating agent. The preferred classes of chelating agents include but are not limited to, ethylenediaminetetraacetic acid (EDTA) and various salts thereof (e.g., sodium, potassium, and ammonium salts); tetrasodium salt of EDTA; methyl glycine diacetic acid, trisodium salt in water; and diethylene triamine pentaacetic acid. In a preferred embodiment, the cleaning composition comprises a chelating agent in an amount ranging from about 1% to about 50% on an active basis, about 1% to about 38% on an active basis, and more preferably about 24% based on active basis (e.g., 63% (% by weight) of a 38% active chelating agent). Without being bound by theory, one or more chelating agents may be used in the stable cleaning composition as each chelating agent may have different functions. For example, while one chelating agent may be better suited for chelating calcium, another chelating agent may be better suited for chelating iron, so the combination would be beneficial if chelating both calcium and iron were desired. One of ordinary skill in the art would understand how to select the appropriate chelating agent or agents based on the need.

A further element of the stable cleaning composition as described here is water. Soft water or deionized water is preferred. Hard water has minerals that may negatively interact with the other elements of the cleaning composition. Water is present in a preferred embodiment, in an amount that ranges from about 10% to about 70% (based on active basis).

In one embodiment, a cleaning composition is a stable hard food contact surface cleaning composition comprising: EDTA chelating agent, a low-foaming, temperature- and alkaline-stable surfactant, and water. This preferred cleaning composition comprises: (A) a tetrasodium salt of EDTA in an amount ranging from about 1% to about 50%, based on active basis, preferably about 1% to about 38%, based on an active basis; (B) capryleth-9 carboxylic acid (and) hexeth-4 carboxylic acid surfactant blend in an amount ranging from about 5% to about 50%, based on an active basis; and water, soft or deionized, in an amount ranging from about 10% to about 70%. Preferably, a low-foaming temperature- and alkaline-stable surfactant or surfactant blend, such as capryleth-9 carboxylic acid (and) hexeth-4 carboxylic acid is in an amount of about 11% on an active basis (e.g., 12.5% (% by weight) of a minimum 85% active surfactant); tetrasodium salt of EDTA in an amount of about 24% (e.g., 63% (% by weight) of a 38% active); and water making up the remaining amount of about 65%. (See, Tables 2 and 3).

The cleaning composition, useful as an effective cleaner in a variety of cleaning processes, is a stable FCS cleaning composition for use alone or as an additive in a cleaning composition. As an additive, the stable cleaning composition, described here, enhances the performance of other cleaning products or agents. The stable cleaning composition as formulated has several desirable properties. A desired cleaning composition is a low-foaming composition. Another property that is desirable is stability, where the composition does not separate or cloud up at room temperature (about 68° F. to about 77° F.). A cloud point may be greater than 120° F. (>120° F.), greater than 110° F., greater than 105° F., and the like, in order to maintain the desired properties. The cloud point indicates the temperature at which a mixture starts to phase separate and two phases appear, thus becoming cloudy. Specific gravity is known as the ratio of the density of a substance to the density of a reference substance. Another property for consideration is the composition's storage temperature. As high temperature storage of greater than 100° F. may be needed, prior compositions were limited as they were not stable at such high temperatures. However, the compositions described here may even be stably stored at ambient temperatures of about 100° F.-about 120° F.

One of ordinary skill in the art understands that the weight percent amount of each element of the stable cleaning composition is selected based on a priority of the maximum amount of chelating agent, followed by the maximum amount of surfactant, and the remaining amount comprising water, where the stable cleaning composition has the desired properties, including but not limited to a specific gravity of about 1.150 to about 1.200, preferably from about 1.183 to about 1.193; a pH ranging from about 4 to about 14, preferably about pH 9 to about 11; a low foam height ranging from about 0 mm to about 60 mm (in a 1 solution; Ross-Miles Foam Height test), or an initial reading of about 0 mL to about 250 mL and a five minute reading of less than or equal to about 50 mL (in a 1% solution using the Cylinder Shake Test (see, Example 3, Table 5); and stable, where the composition does not separate or cloud up.

Another embodiment is directed to a stable cleaning composition with a combination of surfactants in addition to the chelating agent and water components. In particular, the surfactants in a preferred stable cleaning composition are a combination of (A) a low-foaming, temperature- and alkaline-stable hydrotrope surfactant; and (B) a C12-C14 linear alcohol ethylene oxide/propylene oxide (EO/PO) low-foaming, non-ionic surfactant. When a combination of surfactants are used, the concentration or amount of chelating agent needs to be lowered. A preferred ratio of (A) low-foaming, temperature- and alkaline-stable hydrotrope surfactant to (B) C12-C14 linear alcohol ethylene oxide/propylene oxide (EO/PO) low-foaming, non-ionic surfactant (A:B) is 4:1. This preferred cleaning composition comprises: (A) a low-foaming, temperature- and alkaline-stable hydrotrope surfactant in an amount ranging from about 4% to about 20%; and (B) a C12-C14 linear alcohol ethylene oxide/propylene oxide (EO/PO) low-foaming, non-ionic surfactant in an amount ranging from about 1% to about 5%. However, a maximal amount of chelating agent is desired and thus dictates the amount of surfactants. A preferred stable food-contact-surface cleaning composition comprises: a tetrasodium salt of EDTA; a capryleth-9 carboxylic acid (and) hexeth-4 carboxylic acid; a C12-C14 linear alcohol ethylene oxide/propylene oxide (EO/PO) low-foaming, non-ionic surfactant; and water. Preferably, the composition contains the hydrotrope surfactant or surfactant blend in an amount of about 11% on an active basis (e.g., 13% (% by weight) of a minimum 85% active surfactant); the non-ionic surfactant in an amount of about 3% on an active basis; tetrasodium salt of EDTA in an amount of about 20% (e.g., 53% (% by weight) of a minimum 38% active); and water making up the remaining amount of about 66% (See, Tables 2 and 4).

As used here, the term "about" modifies the amount or quantity of an ingredient in the compositions of the invention or used in the methods of the invention described here. One of ordinary skill in the art understands that variation in the numerical quantity can occur, for example, through typical measuring and liquid handling procedures used for making compositions or use solutions in real world applications. Inadvertent error in these procedures, differences in the manufacture, source, or purity of the ingredients employed to make the compositions or carry out the methods, and the like, may result in a variation. The term "about" also encompasses amounts that differ due to different equilibrium conditions for a composition resulting from a particular initial mixture. Whether or not modified by the term "about", the claims include equivalents to the quantities.

Methods of Preparing the Compositions

The method of preparing the stable cleaning composition comprises mixing the low-foaming, temperature- and alkaline-stable surfactant or surfactant blend, chelating agent, and water. To prepare the stable cleaning composition described here, the low-foaming, temperature- and alkaline-stable surfactant or surfactant blend may be diluted in water. Typically, deionized water or soft water is used in the preparation or dilution of the surfactant or surfactant blend. Since many surfactants do not prefer highly alkaline conditions, but rather neutral conditions, and without being bound by theory, by diluting the surfactant in water before mixing together a chelating agent, the shock to the surfactant is minimized. Normally, many cleaning compositions bind coupling agents to the surfactants to assist in minimizing the shock to the surfactant; however, coupling agents are not necessary in the stable cleaning compositions described here. After the surfactant has completely or nearly completely gone into solution, a chelating agent may be combined or mixed. The stable cleaning composition is made or produced under ambient temperature and pressure, more specifically, about 68° F. to about 77° F. and 1 atm. Although a preferred method has steps to initially dilute the surfactant and then mix with a chelating agent, the final cleaning composition made by such a method and its properties can also be prepared by first diluting a chelating agent in water and then adding surfactant. Because the cleaning composition is reactive and aggressive in nature, a vessel or tank made of a non-reactive material is necessary for use in the production of the cleaning composition. Exemplary non-reactive materials for mixing the elements of the described cleaning composition include stainless steel and high density polyethylene (HDPE).

An alternative embodiment is directed to the preparation of a stable cleaning composition containing a combination of (A) a low-foaming, temperature- and alkaline-stable hydrotrope surfactant to (B) a C12-C14 linear alcohol ethylene oxide/propylene oxide (EO/PO) low-foaming, non-ionic surfactant in a ratio of 4:1. Since maximizing the chelating agent is preferred, a ratio of hydrotrope surfactant to non-ionic surfactant of 3:1 would necessitate the decrease in chelating agent. However, if the ratio of hydrotrope surfactant to non-ionic surfactant is 5:1, the amount of chelating agent utilized is the same as that in the 4:1 ratio. A synergy exists between the two classes of surfactants which assists in the solubility of the surfactants. Therefore, a preferred ratio of hydrotrope surfactant to non-ionic surfactant allows for the hydrotrope surfactant to solubilize the non-ionic surfactant in a high electrolyte solution and for the cleaning composition to maintain its low-foaming and cleaning properties.

Similar to the preparation of a single surfactant stable cleaning composition, the method of preparing the stable cleaning composition having more than one surfactant comprises mixing the low-foaming, temperature- and alkaline-stable hydrotrope surfactant or hydrotrope surfactant blend, the C12-C14 linear alcohol ethylene oxide/propylene oxide (EO/PO) low-foaming, non-ionic surfactant, the chelating agent, and water. Deionized water or soft water may be used to dilute the surfactants, either simultaneously or prior to mixture of the other elements of the stable cleaning composition. For example, a low-foaming, temperature- and alkaline-stable hydrotrope surfactant and a C12-C14 linear alcohol ethylene oxide/propylene oxide (EO/PO) low-foaming, non-ionic surfactant may be diluted with water by initially mixing water and the two surfactant classes, by separately diluting each of the surfactant classes, or by diluting one surfactant class followed by the addition of the second surfactant class. Once the surfactants are in solution, or nearly in solution, the chelating agent is mixed together. The final combined surfactant ratio of the stable cleaning composition as prepared by any of the described methods remains to be 4:1 of hydrotrope surfactant to non-ionic surfactant.

Methods of Using the Compositions

The stable cleaning composition of the invention may, in certain embodiments, be used in any cleaning method, and more particularly in conventional CIP processes that are well known and commonly used. A further embodiment is directed to a method of cleaning a food contact surface (FCS), comprising: first (A) applying to a food-contact surface a surface cleaning agent and a stable cleaning composition as described here, comprising (i) a low-foaming, temperature- and alkaline-stable surfactant, (ii) a chelating agent, and (iii) water, or (i) a low foaming, temperature- and alkaline-stable hydrotrope surfactant, (ii) a C12-C14 linear alcohol ethylene oxide/propylene oxide (EO/PO) low-foaming, non-ionic surfactant, (iii) a chelating agent, and (iv) water; and then (B) rinsing the cleaned FCS with water. The low-foaming, temperature- and alkaline-stable surfactant or hydrotrope surfactant is preferably capryleth-9 carboxylic acid (and) hexeth-4 carboxylic acid. The C12-C14 linear alcohol ethylene oxide/propylene oxide (EO/PO) low-foaming, non-ionic surfactant is preferably CAS #68439-51-0 (Surfonic® LF-17). The chelating agent is preferably EDTA, and more preferably a tetrasodium salt of EDTA.

Another embodiment is directed to the method further comprising the step of applying an acid wash to the FCS after application of the cleaning agent and the stable cleaning composition and prior to the water rinse. An optional water rinse may also occur after the application of cleaning agent and cleaning composition and before the acid wash. A sanitizing step may also follow the final water rinsing step.

The application of the cleaning agent and the stable cleaning composition may occur separately or simultaneously. As this cleaning process is preferably for CIP processes, the cleaning agent and the cleaning composition are pumped through pipes and equipment to remove contaminants from the FCS. The ratio of surface cleaning agent to cleaning composition is about 10:1. When the cleaning agent is a caustic blend and the stable cleaning composition comprises the preferred 4:1 hydrotrope surfactant to non-ionic surfactant, the amount of cleaning agent used is surprisingly reduced as compared to the cleaning composition comprising the hydrotrope surfactant alone.

Typically, CIP processes used diluted caustic cleaning agents, long acid cleaning times to remove mineral buildups, and high pressure water rinses. However, the described stable cleaning composition of the invention allows for fewer and shorter water rinse times, less cleaning agents, less acid rinse amounts, lower acid concentrations, and shorter acid wash times when used to clean contaminated FCS. As a result, the time, costs, water use, and waste generated when utilizing the cleaning compositions and methods described here are drastically decreased.

Depending on the industrial use, the CIP process using the described stable cleaning composition may remove organic or inorganic contaminants, such as for example, food, beverage, or soils. The alkaline cleaning solution comprising the inventive stable cleaning composition softens the contaminants and removes the organic alkaline soluble materials or contaminants. The subsequent acid wash removes mineral contaminants remaining after the alkaline cleaning step. The strength of the alkaline and acid solutions and the duration of the cleaning steps generally depend on the difficulty of removing the contaminant. The water rinse step removes any residual solution and contaminants, and cleans the surface prior to the processing industrial equipment being returned to use. A sanitizing step may also be included, preferably as the last step prior to contact with consumables or products that consumers apply.

INDUSTRIAL APPLICATIONS AND BENEFITS

The stable cleaning compositions of the described invention have many beneficial effects, including, but not limited to, (1) reducing the time necessary for cleaning allowing for more frequent cleanings if so desired; (2) decreasing the volume of cleaners, such as chelated caustic soda per CIP cycle; (3) decreasing the amount of water used in the cleaning process; (4) reducing the amount of solids in the waste solution; and (5) decreasing the amount of acid necessary to neutralize the alkaline residues after cleaning. The amount of time to clean takes away from the time for processing products, especially in CIP processes. This "down time" is reduced by using the inventive compositions and methods described here allowing the prompt return to production immediately after cleaning. In tests, the stable cleaning composition comprising the hydrotrope surfactant and non-ionic surfactant was found to be a particularly effective cleaner. Using such a stable cleaning composition would not necessarily require an acid wash after the application of the cleaning agent and cleaning composition and before the water rinse. The cleaning agent and this particular stable cleaning composition is surprisingly effective in cleaning the contaminants on FCS.

The stable cleaning compositions described throughout also allow for the potential use for rapid intermittent cleaning of heavy soils, such as burnt on proteins, fats, and the like, found in any food processing plant. Additional cleaning cycles may ensure healthier, tastier food products, as well as higher quality products overall. These stable cleaning compositions described here may also be useful to clean a variety of contaminated surfaces. The described stable cleaning compositions may be used to clean soils from surfaces that include, but are not limited to, non-reactive surfaces such as for example, stainless steel and plastics; ferrous and non-ferrous metals, iron, galvanic metals, brass, copper, soft metals; and the like.

EXAMPLES

Some embodiments of the present invention are more particularly described in the following examples and are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques.

Example 1

Stability Testing of Cleaning Compositions

To determine the stability of cleaning composition formulations, visual determination of cloudiness and/or physical separation were observed. The formulas in Table 1 were determined to be unstable. The below percentages are by weight unless otherwise noted.

TABLE 1

| INGREDIENT | FORMULA A | FORMULA B |
|---|---|---|
| Chelating Agent (38% active) | 87.5% | 68.5% |
| C12-C14 linear alcohol EO/PO, low-foaming non-ionic surfactant | 12.5% | 12.5% |
| Water, soft | — | 19% |

Formulas A and B containing a large amount of tetrasodium salt of EDTA chelating agent (38% active) (The Dow Chemical Company; Product Code: 00090623; Midland, Mich.) and a C12-C14 linear alcohol ethylene oxide/propylene oxide (EO/PO) low-foaming, non-ionic surfactant (Surfonic® LF-17; 100% active; Huntsman Petrochemical Corporation; LF17; Houston, Tex.) were found to be unstable. Despite attempts, a stable product could not be formed using any amount of chelating agent when mixed with any amount of the C12-C14 linear alcohol EO/PO low-foaming, non-ionic surfactant, as the formulation would separate.

A different surfactant was then used for mixing with the chelating agent. The low-foaming, temperature- and alkaline-stable hydrotrope surfactant, capryleth-9 carboxylic acid (and) hexeth-4 carboxylic acid, (minimum 85 active) (AKYPO® LF4; Kao Corporation; Barcelona, Spain) demonstrated better results in providing stable formulations. The following formulations in Table 2 were developed. The below percentages are by weight unless otherwise noted.

TABLE 2

| INGREDIENT | FORMULA C | FORMULA D |
|---|---|---|
| tetrasodium salt of EDTA, 38% active | 63.0% | 53.33% |
| capryleth-9 carboxylic acid (and) hexeth - 4 carboxylic acid (85% active) | 12.5% | 13.34% |
| C12-C14 linear alcohol EO/PO low-foaming, non-ionic surfactant (100% active) | — | 3.33% |
| Water, soft | 24.5% | 30.00% |

Formula C was based on a maximum amount of tetrasodium salt of EDTA chelating agent that could be mixed (23.94%, recalculated on an active basis) with surfactant in order to obtain a stable product with a cloud point of greater than 120° F. Formula C remained stable when kept at a temperature of 38° F.

Formula D utilized two surfactants, a low-foaming, temperature- and alkaline-stable hydrotrope surfactant and a C12-C14 linear alcohol ethylene oxide/propylene oxide (EO/PO) low-foaming, non-ionic surfactant. The non-ionic surfactant, Surfonic® LF-17, in an amount of 3.33% was used in the presence of the hydrotrope surfactant, capryleth-9 carboxylic acid (and) hexeth-4 carboxylic acid (AKYPO® LF4; Kao Corporation; Barcelona, Spain). For this formulation, the maximum amount of chelating agent, tetrasodium salt of EDTA, allowed was 20.27% (recalculated on an active basis). The resulting Formula D having a cloud point of 106° F. was stable and remained stable when maintained at a temperature of 38° F. The above formulations were prepared on a small scale for experimental purposes.

Example 2

Stable Cleaning Compositions

The stable cleaning composition in Table 3 was prepared by diluting a surfactant in soft water, and then adding a chelating agent. The surfactant used was capryleth-9 carboxylic acid (and) hexeth-4 carboxylic acid (85% active) (MACAT® AEC-8964; Mason Chemical Company; Arlington Heights, Ill., USA), and the chelating agent used was Versene™ 100 (Dow Chemical Company; Midland, Mich., USA). The cleaning composition was targeted to have a specific gravity of 1.188±0.005, a pH of 10.03±0.5, and a chelating agent content of about 24%, based on an active basis. Table 3 below identifies the percent by weight of the ingredients. There was no waste factor and the pounds per gallon (PPG) factor was 8.34.

TABLE 3

| | FORMULA C | |
|---|---|---|
| INGREDIENT | % of Ingredients in Formula C | % Total (based on 100% active) |
| Water, soft | 24.5% | 65.5% |
| capryleth - 9 carboxylic acid (and) hexeth - 4 carboxylic acid (85% active) | 12.5% | 10.6% |
| tetrasodium salt of EDTA (38% active) | 63.0% | 23.9% |

The stable cleaning composition in Table 4 was prepared by mixing surfactants in soft water, and then mixing a chelating agent. Specifically, capryleth-9 carboxylic acid (and) hexeth-4 carboxylic acid was mixed in water until dissolved; then the C12-C14 linear alcohol ethylene oxide/propylene oxide (EO/PO) low-foaming, non-ionic surfactant was added and mixed until dissolved; and once the surfactants were dissolved, the chelating agent, tetrasodium salt of EDTA (38% active) was added and mixed. The surfactants used were capryleth-9 carboxylic acid (and) hexeth-4 carboxylic acid (85% active) (MACAT® AEC-8964; Mason Chemical Company; Arlington Heights, Ill., USA) and Surfonic LF-17 (CAS #68439-51-0; Huntsman Petrochemical Corporation; Houston, Tex.), and the chelating agent used was a tetrasodium salt of EDTA (Versene™ 100; Dow Chemical Company; Midland, Mich., USA). The stable cleaning composition was targeted to have a specific gravity of 1.162±0.005, a pH of 9.34±0.5, and a chelating agent content of about 24%, based on an active basis. Table 4 below identifies the percent by weight of the ingredients. There was no waste factor and the pounds per gallon (PPG) factor was 8.34.

TABLE 4

| INGREDIENT | FORMULA D % of Ingredients in Formula D | FORMULA D % Total (based on 100% active) |
|---|---|---|
| EDTA, 38% active | 53.33% | 20.27% |
| capryleth - 9 carboxylic acid (and) hexeth - 4 carboxylic acid (85% active) | 13.34% | 11.34% |
| C12-C14 linear alcohol EO/PO low-foaming, non-ionic surfactant (100% active) | 3.33% | 3.33% |
| Water, soft | 30.00% | 65.06% |

Example 3

Foam Height Determination

Cylinder Shake Test

This method determined the foam height of a particular tested product. It was performed primarily to compare foaming characteristics of two or more potentially foaming products.

A 1% solution of the product to be tested was prepared by weighing 2 grams of the product in a beaker and adding 198 grams of distilled water. The distilled water was at room temperature (about 78° C.). The 1% solution was mixed and 100 grams of the solution was transferred into a 500 mL graduated cylinder. The appropriate stopper was placed prior to vigorously shaking the cylinder up and down twenty times. The initial height of the foam was measured and recorded. After one minute, the height of the liquid just below the foam was measured and recorded. After a total of five minutes, the height of the foam was measured and recorded, as was the height of the liquid just below the foam. TABLE 5 shows the parameters of products that are low foam, moderate foam, and high foam.

TABLE 5

| FOAM HEIGHT VALUES | HIGH FOAM | MODERATE FOAM | LOW FOAM |
|---|---|---|---|
| INITIAL READING | >250 mL | ≥250 mL | ≤250 mL |
| 5 MINUTES READING | ≥250 mL | >50 mL, but <250 mL | ≤50 mL |

While various embodiments have been described above, it should be understood that such disclosures have been presented by way of example only and are not limiting. Thus, the breadth and scope of the subject compositions and methods should not be limited by any of the above-described exemplary embodiments, but should be defined only in accordance with the following claims and their equivalents.

Having now fully described the subject compositions and methods, it will be understood by those of ordinary skill in the art that the same can be performed within a wide and equivalent range of conditions, formulations and other parameters without affecting their scope or any embodiment thereof. All cited patents, patent applications and publications are fully incorporated by reference in their entirety.

What is claimed is:

1. A stable, alkaline composition comprising: about 5% to about 50% of a low-foaming, temperature- and alkaline-stable surfactant, about 20% to about 50% of a chelating agent, and the balance of water.

2. The composition of claim 1, wherein the surfactant comprises a hydrotrope surfactant.

3. The composition of claim 2, wherein the surfactant is capryleth-9 carboxylic acid (and) hexeth-4 carboxylic acid.

4. The composition of claim 1, wherein the surfactant is a combination of a low-foaming, temperature- and alkaline-stable hydrotrope surfactant and a C12-C14 linear alcohol ethylene oxide/propylene oxide (EO/PO) low-foaming, non-ionic surfactant.

5. The composition of claim 4, wherein the hydrotrope surfactant and non-ionic surfactant are in a ratio of 4:1.

6. The composition of claim 1, wherein the chelating agent is selected from the group consisting of: ethylenediaminetetraacetic acid (EDTA); sodium, potassium, and ammonium salts of EDTA; a tetrasodium salt of ethylenediaminetetraacetic acid; methyl glycine diacetic acid, trisodium salt; and diethylene triamine pentacetic acid.

7. A method of preparing a stable, alkaline cleaning composition, comprising:

mixing (a) water; (b) about 5% to about 50% of a low-foaming, temperature- and alkaline-stable surfactant; and (c) about 20% to about 50% of a chelating agent.

8. The method of claim 7, wherein the surfactant is capryleth-9 carboxylic acid (and) hexeth-4 carboxylic acid.

9. The method of claim 7, wherein the surfactant is a combination of a low-foaming, temperature- and alkaline-stable hydrotrope surfactant and a C12-C14 linear alcohol ethylene oxide/propylene oxide (EO/PO) low-foaming, non-ionic surfactant.

10. The method of claim 9, wherein the hydrotrope surfactant and non-ionic surfactant are in a ratio of 4:1.

11. The method of claim 7, wherein the chelating agent is a tetrasodium salt of ethylenediaminetetraacetic acid (EDTA).

12. A stable, alkaline food-contact-surface cleaning composition, comprising:

a) about 20%-about 50% tetrasodium salt of EDTA;

b) about 5%-about 50% low-foaming, temperature- and alkaline-stable surfactant; and c) the balance of water.

13. The composition of claim 12, wherein the composition comprises about 24% tetrasodium salt of EDTA; about 11% capryleth-9 carboxylic acid (and) hexeth-4 carboxylic acid; and the balance of water.

14. The composition of claim 12, wherein the composition comprises about 20% tetrasodium salt of EDTA; about 11% capryleth-9 carboxylic acid (and) hexeth-4 carboxylic acid; about 3% C12-C14 linear alcohol ethylene oxide/propylene oxide (EO/PO) low-foaming, non-ionic surfactant; and the balance of water.

15. A stable, alkaline composition consisting of: a low-foaming, temperature- and alkaline-stable surfactant, a chelating agent, and water.

16. A method of preparing a stable, alkaline cleaning composition of claim 15, comprising mixing (a) a low-foaming, temperature- and alkaline-stable surfactant; (b) a chelating agent; and (c) water.

17. The method of claim 16, wherein the chelating agent is first mixed with water, and then mixed with the low-foaming, temperature- and alkaline-stable surfactant.

18. The method of claim 16, wherein the low-foaming, temperature- and alkaline-stable surfactant is first mixed with water, and then mixed with the chelating agent.

19. A method of preparing a stable, alkaline cleaning composition of claim 1, comprising mixing (a) a low-foaming, temperature- and alkaline-stable surfactant; (b) a chelating agent; and (c) water.

20. The method of claim 19, wherein the chelating agent is first mixed with water, and then mixed with the low-foaming, temperature- and alkaline-stable surfactant.

21. The method of claim 19, wherein the low-foaming, temperature- and alkaline-stable surfactant is first mixed with water, and then mixed with the chelating agent.

22. The method of claim 7, wherein the chelating agent is first mixed with water, and then mixed with a low-foaming, temperature- and alkaline-stable surfactant.

23. The method of claim 7, wherein the low-foaming, temperature- and alkaline-stable surfactant is first mixed with water, and then mixed with the chelating agent.

24. A method of preparing a stable, alkaline cleaning composition of claim 12, comprising mixing (a) a low-foaming, temperature- and alkaline-stable surfactant; (b) EDTA; and (c) water.

25. The method of claim 24, wherein EDTA is first mixed with water, and then mixed with the low-foaming, temperature- and alkaline-stable surfactant.

26. The method of claim 24, wherein the low-foaming, temperature- and alkaline-stable surfactant is first mixed with water, and then mixed with EDTA.

* * * * *